US010558148B2

(12) United States Patent
Ichihashi

(10) Patent No.: US 10,558,148 B2
(45) Date of Patent: Feb. 11, 2020

(54) BELT DEVICE AND IMAGE FORMING APPARATUS INCORPORATING SAME

(71) Applicant: Osamu Ichihashi, Kanagawa (JP)

(72) Inventor: Osamu Ichihashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/355,764

(22) Filed: Mar. 17, 2019

(65) Prior Publication Data

US 2019/0302654 A1 Oct. 3, 2019

(30) Foreign Application Priority Data

Mar. 30, 2018 (JP) ..... 2018-067412
Sep. 5, 2018 (JP) ..... 2018-166143

(51) Int. Cl.
*G03G 15/16* (2006.01)

(52) U.S. Cl.
CPC ..... *G03G 15/161* (2013.01); *G03G 15/162* (2013.01); *G03G 15/168* (2013.01); *G03G 2215/1661* (2013.01)

(58) Field of Classification Search
CPC ... G03G 15/161; G03G 15/162; G03G 15/168
See application file for complete search history.

(56) References Cited

U.S. PATENT DOCUMENTS 8,971,761 B2 * 3/2015 Yuasa ..... G03G 15/0189 399/121
2012/0121293 A1 5/2012 Mimbu et al.
2012/0224879 A1 9/2012 Fujita et al.
2012/0237260 A1 9/2012 Sengoku et al.
2013/0114982 A1 5/2013 Ichihashi et al.
2013/0189002 A1 7/2013 Ichihashi et al.
2013/0223901 A1 8/2013 Minbe et al.
2013/0243482 A1 9/2013 Kato et al.
2013/0322935 A1 12/2013 Ichihashi et al.
2014/0016970 A1 1/2014 Ichihashi
(Continued)

FOREIGN PATENT DOCUMENTS

JP 2010-019899 1/2010
JP 2014-159336 9/2014

OTHER PUBLICATIONS

Yokokawa et al. (JP 2010-019899 A), Jan. 2010, JPO Computer Translation (Year: 2010).*

*Primary Examiner* — Erika J Villaluna
(74) *Attorney, Agent, or Firm* — Oblon, McClelland, Maier & Neustadt, L.L.P.

(57) ABSTRACT

A belt device includes a plurality of rollers, a belt stretched and supported around the plurality of rollers, a roller shaft included in one of the plurality of rollers and configured to rotate along with the one of the plurality of rollers, a shaft inclination member slidably supported by the roller shaft, a cleaning member opposed to the one of the plurality of rollers via the belt, a bearing configured to rotatably support the roller shaft, and a support configured to rotatably support the bearing. The shaft inclination member is configured to incline the roller shaft in conjunction with movement in which the belt moves in a width direction of the belt device. The cleaning member is configured to clean the belt. The bearing is configured to stationarily support the cleaning member.

10 Claims, 11 Drawing Sheets

(56) References Cited

U.S. PATENT DOCUMENTS

| | | | |
|---|---|---|---|
| 2014/0072340 | A1 | 3/2014 | Kato et al. |
| 2014/0209437 | A1 | 7/2014 | Hozumi et al. |
| 2014/0314435 | A1 | 10/2014 | Kato et al. |
| 2014/0328603 | A1 | 11/2014 | Mizutani et al. |
| 2014/0328604 | A1 | 11/2014 | Tanaka et al. |
| 2014/0334847 | A1 | 11/2014 | Takahashi et al. |
| 2016/0139543 | A1 | 5/2016 | Imai et al. |
| 2017/0010566 | A1 | 1/2017 | Kato et al. |
| 2017/0168429 | A1 | 6/2017 | Imai et al. |
| 2017/0168430 | A1 | 6/2017 | Imai et al. |
| 2018/0143570 | A1 | 5/2018 | Mizutani et al. |
| 2018/0157209 | A1 | 6/2018 | Fujita et al. |

* cited by examiner

BELT DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2018-067412, filed on Mar. 30, 2018 and 2018-166143, filed on Sep. 5, 2018, in the Japan Patent Office, the entire disclosure of each of which is hereby incorporated by reference herein.

BACKGROUND

Technical Field

This disclosure relates to a belt device including a belt that rotates in a predetermined direction and an image forming apparatus including the belt device, such as a copier, a printer, a facsimile machine, or a multifunction peripheral (MFP) having at least two functions of the copier, printer, and facsimile machine.

Description of the Related Art

There are known image forming apparatuses such as copiers and printers including a correction mechanism (a belt alignment device) to correct belt deviation of a belt such as an intermediate transfer belt.

SUMMARY

According to embodiments of the present disclosure, an improved belt device includes a plurality of rollers, a belt stretched and supported around the plurality of rollers, a roller shaft included in one of the plurality of rollers and configured to rotate along with the one of the plurality of rollers, a shaft inclination member slidably supported by the roller shaft, a cleaning member opposed to the one of the plurality of rollers via the belt, a bearing configured to rotatably support the roller shaft, and a support configured to rotatably support the bearing. The shaft inclination member is configured to incline the roller shaft in conjunction with movement in which the belt moves in a width direction of the belt device. The cleaning member is configured to clean the belt. The bearing is configured to stationarily support the cleaning member.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
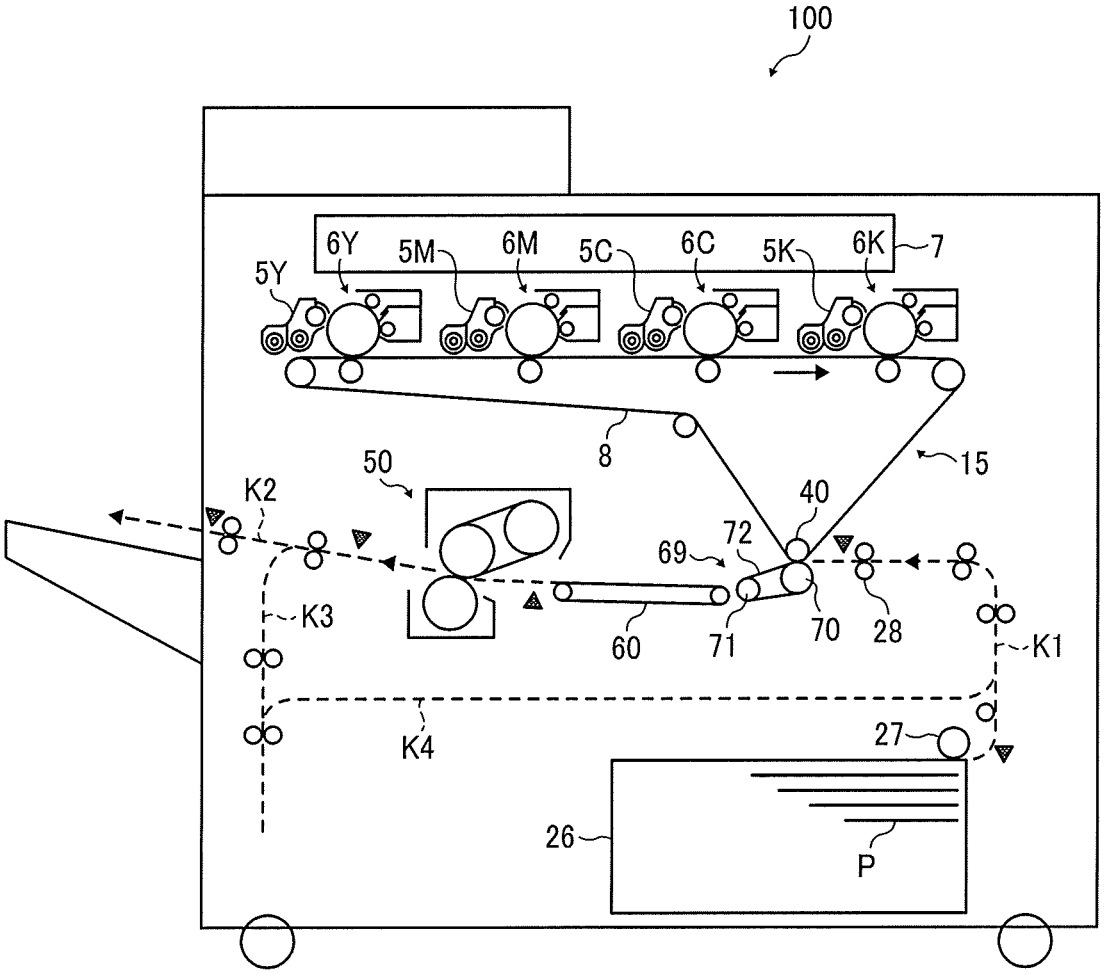
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Embodiments of the present disclosure are described in detail with reference to drawings. It is to be understood that identical or similar reference numerals are assigned to identical or corresponding components throughout the drawings, and redundant descriptions are omitted or simplified below.

Figure 2:
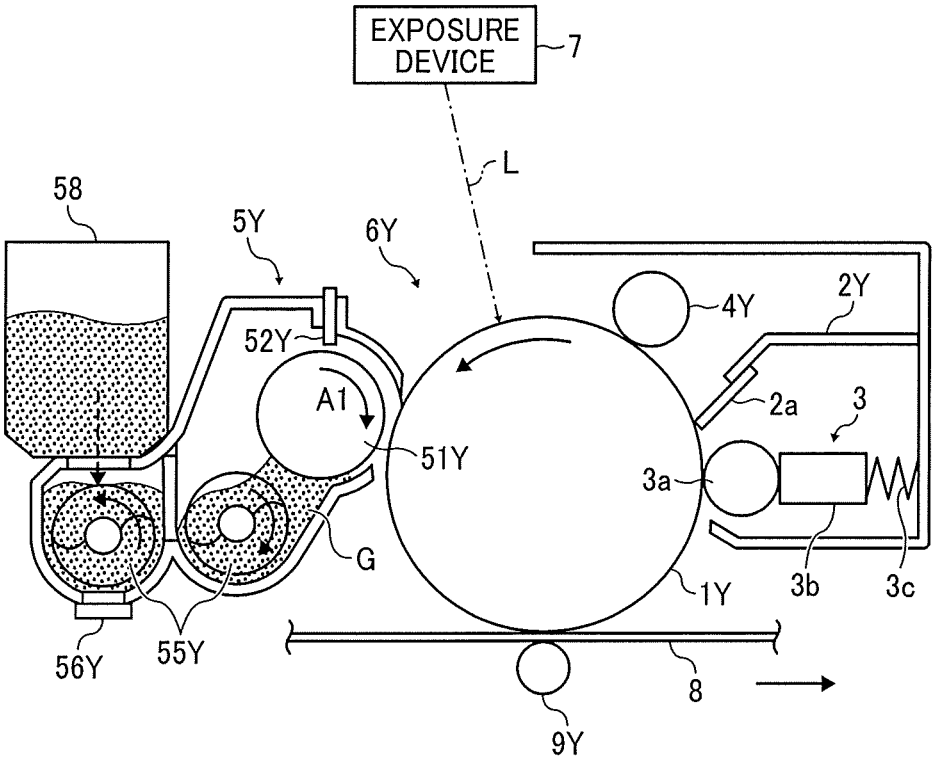
FIG. 2 is an enlarged schematic view illustrating a configuration of an image forming device of the image forming apparatus according to an embodiment of the present disclosure.

With reference to FIGS. 1 and 2, a configuration and operations of an image forming apparatus 100 according to the present embodiment is described below.

FIG. 1 is a schematic view illustrating a configuration and operations of the image forming apparatus 100, which in the present embodiment is a printer. FIG. 2 is an enlarged schematic view illustrating a part of the image forming device 6Y of the image forming apparatus 100.

As illustrated in FIG. 1, the image forming apparatus 100 includes an intermediate transfer belt device 15 as a belt device at the center of an apparatus body thereof. Image forming devices 6Y, 6M, 6C, and 6K are arranged in parallel, facing an intermediate transfer belt (a belt) 8 of the intermediate transfer belt device 15 to form toner images of yellow, magenta, cyan, and black, respectively.

With reference to FIG. 2, the image forming device 6Y for yellow includes a photoconductor drum 1Y and a charger 4Y, a developing device 5Y, a cleaning device 2Y, a lubricant applicator 3, and a discharger provided around the photoconductor drum 1Y. Image forming processes, namely, charging, exposure, development, transfer, and cleaning processes are performed on the photoconductor drum 1Y, and thus a yellow toner image is formed on the photoconductor drum 1Y.

The other three image forming devices 6M, 6C, and 6K have a similar configuration to that of the yellow image forming device 6Y except for the color of the toner used therein and form magenta, cyan, and black toner images, respectively. Thus, only the image forming device 6Y is described below and descriptions of the other three image forming devices 6M, 6C, and 6K are omitted.

With reference to FIG. 2, the photoconductor drum 1Y is rotated counterclockwise in FIG. 2 by a main motor. The charger 4Y uniformly charges a surface of the photoconductor drum 1Y at a position opposite the charger 4Y (a charging process).

Then, the charged surface of the photoconductor drum 1Y reaches a position to receive a laser beam L emitted from an exposure device 7, and the photoconductor drum 1Y is scanned with the laser beam L in a width direction at the position, thereby forming an electrostatic latent image for yellow on the surface of the photoconductor drum 1Y (an exposure process). The width direction is a main-scanning direction perpendicular to the surface of the paper on which FIGS. 1 and 2 are drawn.

The surface of the photoconductor drum 1Y carrying the electrostatic latent image reaches a position opposite the developing device 5Y, and the electrostatic latent image is developed into a toner image of yellow at the position (a development process).

When the surface of the photoconductor drum 1Y carrying the toner image reaches a position opposite a primary transfer roller 9Y via the intermediate transfer belt 8, the toner image is transferred from the photoconductor drum 1Y onto a surface of the intermediate transfer belt 8 at the position (a primary transfer process). After the primary transfer process, a certain amount of untransferred toner remains on the photoconductor drum 1Y.

When the surface of the photoconductor drum 1Y reaches a position opposite the cleaning device 2Y, a cleaning blade 2*a* collects the untransferred toner from the photoconductor drum 1Y into the cleaning device 2Y (a cleaning process).

The cleaning device 2Y includes a lubricant supply roller 3*a*, a solid lubricant 3*b*, and a compression spring 3*c*, which constitute a lubricant applicator 3 for the photoconductor drum 1Y. The lubricant supply roller 3*a* rotating clockwise in FIG. 2 rubs a small amount of lubricant from the solid lubricant 3*b* and applies the lubricant to the surface of the photoconductor drum 1Y.

Subsequently, the surface of the photoconductor drum 1Y reaches a position opposite the discharger, and the discharger removes a residual potential from the photoconductor drum 1Y.

Thus, a sequence of image forming processes performed on the photoconductor drum 1Y is completed.

The above-described image forming processes are performed in the image forming devices 6M, 6C, and 6K similarly to the yellow image forming device 6Y. That is, the exposure device 7 disposed above the image forming devices 6M, 6C, and 6K irradiates the photoconductor drums 1M, 1C, and 1K of the image forming devices 6M, 6C, and 6K with the laser beams L based on image data. Specifically, the exposure device 7 includes a light source to emit the laser beams L, multiple optical elements, and a polygon mirror that is rotated by a motor. The exposure device 7 directs the laser beams L to the photoconductor drums 1M, 1C, and 1K via the multiple optical elements while deflecting the laser beams L with the polygon mirror. Alternatively, an exposure device 7 in which a plurality of light emitting diodes (LEDs) is arranged side by side in the width direction can be used.

Then, the toner images formed on the photoconductor drums 1M, 1C, and 1K through the development process of the developing devices 5M, 5C, and 5K are primarily transferred therefrom and superimposed onto the intermediate transfer belt 8. Thus, a multicolor toner image is formed on the intermediate transfer belt 8.

Figure 3:
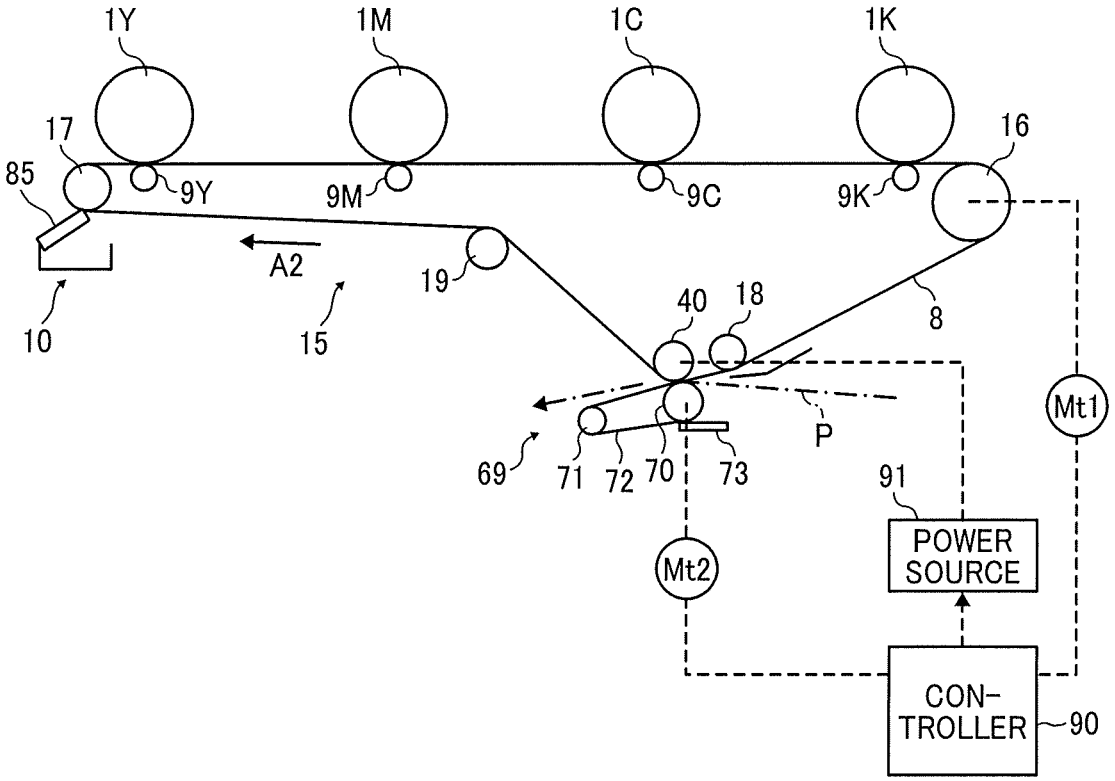
FIG. 3 is a schematic view of an intermediate transfer belt device of the image forming apparatus and the vicinity thereof according to an embodiment of the present disclosure.

The intermediate transfer belt 8 as the belt is stretched and supported around a plurality of rollers 16 through 19 and 40 and is rotated by the drive roller 16 driven by a drive motor Mt1 in a direction indicated by arrow A2 in FIG. 3.

The four primary transfer rollers 9Y, 9M, 9C, and 9K are pressed against the corresponding photoconductor drums 1Y, 1M, 1C, and 1K, respectively, via the intermediate transfer belt 8 to form primary transfer nips. Transfer voltages (primary transfer biases) opposite in polarity to toner are applied to the primary transfer rollers 9Y, 9M, 9C, and 9K.

While rotating in the direction indicated by arrow A2 in FIG. 3, the intermediate transfer belt 8 sequentially passes through the primary transfer nips between the photoconductor drums 1Y, 1M, 1C, and 1K and the respective primary transfer rollers 9Y, 9M, 9C, and 9K. Then, the single-color toner images on the photoconductor drums 1Y, 1M, 1C, and 1K are primarily transferred and superimposed onto the intermediate transfer belt 8, thereby forming the multicolor toner image on the intermediate transfer belt 8 (a primary transfer process).

Then, the intermediate transfer belt 8 carrying the multicolor toner image reaches a position opposite a secondary transfer belt 72. The secondary-transfer backup roller 40 and a secondary transfer roller 70 press against each other via the intermediate transfer belt 8 and the secondary transfer belt 72, thereby forming a secondary transfer nip. The multicolor (four-color) toner image on the intermediate transfer belt 8 is transferred onto a sheet P (e.g., a paper sheet) conveyed to the secondary transfer nip (a secondary transfer process). At that time, toner that is untransferred onto the sheet P remains on the surface of the intermediate transfer belt 8.

Then, the intermediate transfer belt 8 reaches a position opposite a belt cleaner 10 of the intermediate transfer belt device 15. At this position, the belt cleaner 10 removes substances adhering to the intermediate transfer belt 8 (e.g., untransferred toner).

Thus, a series of image transfer processes performed on the intermediate transfer belt 8 is completed.

With reference to FIG. 1, the sheet P is conveyed from a sheet feeder 26 provided in a lower portion of the apparatus body of the image forming apparatus 100 to the secondary transfer nip via a feed roller 27 and a registration roller pair 28.

Specifically, the sheet feeder 26 loads a plurality of sheets P (e.g., transfer sheets) layered. As the feed roller 27 rotates counterclockwise in FIG. 1, the topmost sheet P of the plurality of sheets P in the sheet feeder 26 is fed toward a nip between the registration roller pair 28 via a first conveyance path K1.

The registration roller pair (a timing roller pair) 28 temporarily stops rotating, stopping the sheet P with a leading edge of the sheet P nipped in the registration roller pair 28. The registration roller pair 28 resumes rotation to convey the sheet P to the secondary transfer nip, timed to coincide with the arrival of the multicolor toner image on the intermediate transfer belt 8. Thus, the desired multicolor toner image is transferred onto the sheet P.

The sheet P, onto which the multicolor toner image is secondarily transferred, is conveyed on the secondary transfer belt 72 and separated from the secondary transfer belt 72, and then a conveyance belt 60 conveys the sheet P to the fixing device 50. In the fixing device 50, a fixing belt and a pressing roller apply heat and pressure to the sheet P to fix the multicolor toner image on the sheet P (a fixing process).

The sheet P is conveyed through a second conveyance path K2 and ejected by an output roller pair to the outside of the image forming apparatus 100. The sheets P are sequentially stacked as output images on a stack tray.

Thus, a series of image forming processes (printing operations) performed by the image forming apparatus 100 is completed.

Thus, in single-side printing, the sheet P is ejected after the toner image is fixed on the front side of the sheet P. By contrast, in duplex printing to form toner images on both sides (front side and back side) of the sheet P, the sheet P is guided to a third conveyance path K3. After a direction of conveyance of the sheet P is reversed, the sheet P is conveyed again to the secondary transfer nip (a secondary transfer device 69) via a fourth conveyance path K4. Then, through the image forming processes (the printing operations) similar to those described above, the toner image is transferred onto the back side of the sheet P at the secondary transfer nip and fixed thereon by the fixing device 50, after which the sheet P is ejected from the image forming apparatus 100 via the second conveyance path K2.

Next, a detailed description is provided of a configuration and operations of the developing device 5Y with reference to FIG. 2.

The developing device 5Y includes a developing roller 51Y opposed to the photoconductor drum 1Y, a doctor blade 52Y opposed to the developing roller 51Y, two conveying screws 55Y disposed in a developer storage of the developing device 5Y, and a toner concentration sensor 56Y to detect a toner concentration in the developer. The developing roller 51Y includes stationary magnets, a sleeve that rotates around the magnets, and the like. The developer storage contains a two-component developer G including carrier (carrier particles) and toner (toner particles).

The developing device 5Y with such a configuration operates as follows.

The sleeve of the developing roller 51Y rotates in a direction indicated by arrow A1 in FIG. 2. The developer G is carried on the developing roller 51Y by a magnetic field generated by the magnets. As the sleeve rotates, the developer G moves along a circumference of the developing roller 51Y. A ratio of toner to carrier (i.e., toner concentration) in the developer G contained in the developing device 5Y is adjusted within a predetermined range. Specifically, when low toner concentration is detected by the toner concentration sensor 56Y disposed in the developing device 5Y, fresh toner is supplied from a toner container 58 to the developer storage of the developing device 5Y to keep the toner concentration within the predetermined range.

The two conveying screws 55Y stir and mix the developer G with the toner supplied from the toner container 58 to the developer storage while circulating the developer G in the developer storage separated into two compartments. In this case, the developer G moves in a direction perpendicular to the surface of the paper on which FIG. 2 is drawn. The toner in developer G is charged by friction with the carrier and electrostatically attracted to the carrier. Then, the toner is carried on the developing roller 51Y together with the carrier by a magnetic force generated on the developing roller 51Y.

The developer G on the developing roller 51Y is carried in the direction indicated by arrow A1 in FIG. 2 to the doctor blade 52Y. The amount of developer G on the developing roller 51Y is adjusted by the doctor blade 52Y, after which the developer G is carried to a developing region opposed to the photoconductor drum 1Y. The toner in the developer G is attracted to the electrostatic latent image formed on the photoconductor drum 1Y due to the effect of an electric field generated in the developing region. As the sleeve rotates, the developer G remaining on the developing roller 51Y reaches an upper part of the developer storage and separates from the developing roller 51Y.

The toner container 58 is detachably (replaceably) attached to the developing device 5Y (the image forming apparatus 100). When the toner container 58 runs out of fresh toner, the toner container 58 is detached from the developing device 5Y (the image forming apparatus 100) and replaced with a new one.

Next, with reference to FIG. 3, a description is provided of the intermediate transfer belt device 15 according to the present embodiment.

With reference to FIG. 3, the intermediate transfer belt device 15 includes the intermediate transfer belt 8 as the belt, four primary transfer rollers 9Y, 9M, 9C, and 9K, the drive roller 16, a correction roller 17, a pre-transfer roller 18, a tension roller 19, the belt cleaner 10 for the intermediate transfer belt 8, the secondary-transfer backup roller 40, and the like.

The intermediate transfer belt (the belt) 8 is disposed in contact with the four photoconductor drums 1Y, 1M, 1C, and 1K bearing the toner images of the respective colors to form the primary transfer nips. The intermediate transfer belt 8 is mainly stretched taut around and supported by five rollers: the drive roller 16, the correction roller 17, the pre-transfer roller 18, the tension roller 19, and the secondary-transfer backup roller 40.

According to the present embodiment, the intermediate transfer belt 8 as the belt includes a single layer or multiple layers formed of such a material as polyvinylidene fluoride (PVDF), ethylene-tetrafluoroethylene copolymer (ETFE), polyimide (PI), polycarbonate (PC), polyamide imide (PAT), thermoplastic elastomer (TPE), and polyether ether ketone (PEEK), with a conductive material such as carbon black dispersed therein. The volume resistivity of the intermediate transfer belt 8 is adjusted within a range of from $10^6$ to $10^{13}$ Ωcm, and the surface resistivity of the back surface of the intermediate transfer belt 8 is adjusted within a range of from $10^7$ to $10^{13}$ Ω/sq. The thickness of the intermediate transfer belt 8 ranges from 20 to 200 μam. According to the present embodiment, the intermediate transfer belt 8 has a thickness of about 60 μm, and a volume resistivity of about $10^9$ Ωcm.

In some embodiments, the intermediate transfer belt 8 may include a release layer on the surface of the intermediate transfer belt 8 as needed. Examples of a material usable for the release layer include, but are not limited to, fluorocarbon resins such as ETFE, polytetrafluoroethylene (PTFE), PVDF, perfluoroalkoxy polymer resin (PFA), fluorinated ethylene propylene (FEP), and polyvinyl fluoride (PVF).

The primary transfer rollers 9Y, 9M, 9C, and 9K are disposed in contact with the photoconductor drums 1Y, 1M, 1C, and 1K via the intermediate transfer belt 8, respectively. Specifically, the primary transfer roller 9Y for yellow is disposed in contact with the photoconductor drum 1Y for yellow via the intermediate transfer belt 8. The primary transfer roller 9M for magenta is disposed in contact with the photoconductor drum 1M for magenta via the intermediate transfer belt 8. The primary transfer roller 9C for cyan is disposed in contact with the photoconductor drum 1C for cyan via the intermediate transfer belt 8. The primary transfer roller 9K for black is disposed in contact with the photoconductor drum 1K for black via the intermediate transfer belt 8. Each of the primary transfer rollers 9Y, 9M, 9C, and 9K is an elastic roller including a core and a conductive foamed layer on the core. The volume resistivity of each of the primary transfer rollers 9Y, 9M, 9C, and 9K is adjusted within a range of from $10^6$ to $10^{12}$ Ωcm, preferably from $10^7$ to $10^9$ Ωcm.

The drive roller 16 is disposed in contact with an inner circumferential surface of the intermediate transfer belt 8 by an angle of belt winding of about 120 degrees at a position downstream from the four photoconductor drums 1Y, 1M, 1C, and 1K in a direction of rotation of the intermediate transfer belt 8. The drive roller 16 is rotated clockwise in FIG. 3 by the drive motor Mt1, which is controlled by a controller 90. Such a configuration allows the intermediate transfer belt 8 to rotate in a predetermined direction (i.e., clockwise in FIG. 3).

The correction roller 17 is disposed in contact with the inner circumferential surface of the intermediate transfer belt 8 by the angle of belt winding of about 180 degrees at a position upstream from the four photoconductor drums 1Y, 1M, 1C, and 1K in the direction of rotation of the intermediate transfer belt 8. A portion of the intermediate transfer belt 8 from the correction roller 17 to the drive roller 16 is arranged approximately horizontal. The correction roller 17 is rotated clockwise in FIG. 3 as the intermediate transfer belt 8 rotates.

In the present embodiment, when belt deviation of the intermediate transfer belt 8 occurs, the correction roller 17 is inclined relative to an axial direction of the drive roller 16 to correct the belt deviation. This configuration is described in detail later, with reference to FIGS. 4 and 5. The belt deviation means that the intermediate transfer belt 8 moves to one side in a width direction of the intermediate transfer belt device 15.

Figure 4:
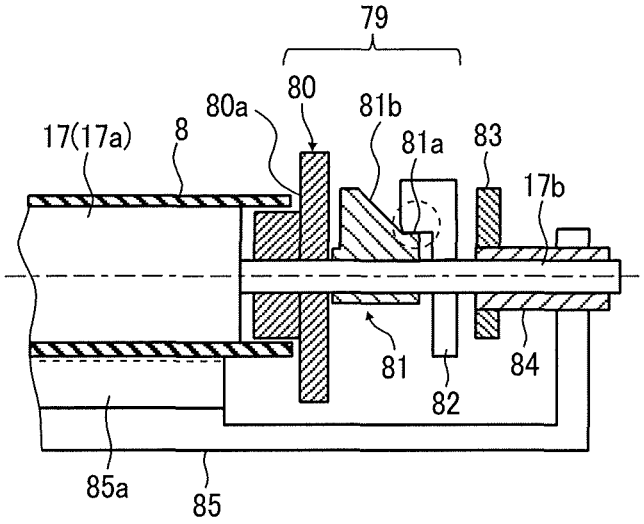
FIG. 4 is a schematic cross-sectional view of end portions of an intermediate transfer belt and a correction roller in a width direction of the intermediate transfer belt device according to an embodiment of the present disclosure.

The belt cleaner 10 is disposed opposite the correction roller 17. The belt cleaner 10 includes a cleaning member 85 that contacts the correction roller 17 via the intermediate transfer belt 8. With reference to FIG. 4, the cleaning member 85 includes a cleaning portion (a cleaning blade) 85*a* that contacts the intermediate transfer belt 8 at a predetermined contact angle and contact pressure.

The tension roller 19 contacts an outer circumferential surface of the intermediate transfer belt 8. The pre-transfer roller 18 and the secondary-transfer backup roller 40 contact the inner circumferential surface of the intermediate transfer belt 8.

As the intermediate transfer belt 8 rotates, the plurality of rollers 17 through 19 and 40 other than the drive roller 16 is rotated according to the direction of rotation of the intermediate transfer belt 8.

With reference to FIG. 3, the secondary-transfer backup roller 40 contacts the secondary transfer roller 70 via the intermediate transfer belt 8 and the secondary transfer belt 72. The secondary-transfer backup roller 40 includes a cylindrical core made of stainless steel and the like, having an elastic layer on an outer circumferential surface of the core. The elastic layer is made of acrylonitrile-butadiene rubber (NBR). The elastic layer has the volume resistivity ranging from approximately $10^7$ to $10^8$ Ωcm, and a hardness ranging from approximately 48 to 58 degrees on Japanese Industrial Standards A hardness (hereinafter, referred to as JIS-A hardness) scale. The elastic layer has a thickness of approximately 5 mm.

According to the present embodiment, the secondary-transfer backup roller 40 is electrically connected to a power source 91, which outputs a high voltage of approximately −5 kV as a secondary transfer bias. With the secondary transfer bias output to the secondary-transfer backup roller 40, the toner image primarily transferred to the surface of the intermediate transfer belt 8 is secondarily transferred onto the sheet P conveyed to the secondary transfer nip. The secondary transfer bias has the same polarity as the polarity of toner. In the present embodiment, the secondary transfer bias is a direct current voltage and has a negative polarity. With this configuration, the toner carried on the outer circumferential surface (a surface bearing the toner) of the intermediate transfer belt 8 electrostatically moves from the secondary-transfer backup roller 40 side toward the secondary transfer device 69.

Next, the secondary transfer device 69 is described in detail below with reference to FIG. 3.

With reference to FIG. 3, the secondary transfer device 69 includes the secondary transfer belt 72, the secondary transfer roller 70, a separation roller 71, and a secondary transfer cleaning blade 73.

The secondary transfer belt 72 is an endless belt stretched taut around a plurality of rollers (i.e., the secondary transfer roller 70 and the separation roller 71). The secondary transfer belt 72 is made of a material similar to that of the intermediate transfer belt 8. The secondary transfer belt 72 contacts the intermediate transfer belt 8 to form the secondary transfer nip and conveys the sheet P fed from the secondary transfer nip.

The secondary-transfer backup roller 40 and the secondary transfer roller 70 press against each other via the intermediate transfer belt 8 and the secondary transfer belt 72, thereby forming the secondary transfer nip. The secondary transfer roller 70 includes a hollow core made of stainless steel or aluminum and an elastic layer (coating) on the core. The elastic layer has a hardness ranging from approximately 40 to 50 degrees on Asker C hardness scale. To form the elastic layer of the secondary transfer roller 70, for example, a rubber material, such as polyurethane, ethylene-propylene-diene monomer (EPDM), and silicone, is formed into a solid or foamed state as follows. A conductive filler, such as carbon, is dispersed in the rubber material. Alternatively, an ionic conductive material is included in the rubber material. According to the present embodiment, the elastic layer of the secondary transfer roller 70 has a volume resistivity ranging from $10^{65}$ to $10^{75}$ Ωcm to prevent concentration of a transfer current. In the present embodiment, the secondary transfer roller 70 is electrically grounded.

As the secondary transfer roller 70 is rotated counterclockwise in FIG. 3 by a motor Mt2 controlled by the controller 90, the secondary transfer belt 72 and the separation roller 71 are rotated counterclockwise in FIG. 3.

The separation roller 71 is disposed downstream from the secondary transfer nip in the direction of conveyance of the sheet P. Ejected from the secondary transfer nip, the sheet P is conveyed along the secondary transfer belt 72 rotating counterclockwise in FIG. 3 and separated from the secondary transfer belt 72 at a curved portion of the secondary transfer belt 72 wound around an outer circumference of the separation roller 71 by self-stripping.

The secondary transfer cleaning blade 73 contacts the surface of the secondary transfer belt 72 to remove substances such as toner and paper dust adhering to the surface of the secondary transfer belt 72. The secondary transfer cleaning blade 73 is pressed against the secondary transfer roller 70 via the secondary transfer belt 72 against the direction of rotation of the secondary transfer belt 72.

Descriptions are given below of the configuration and operations of the intermediate transfer belt device 15 as the belt device.

Figure 5A:
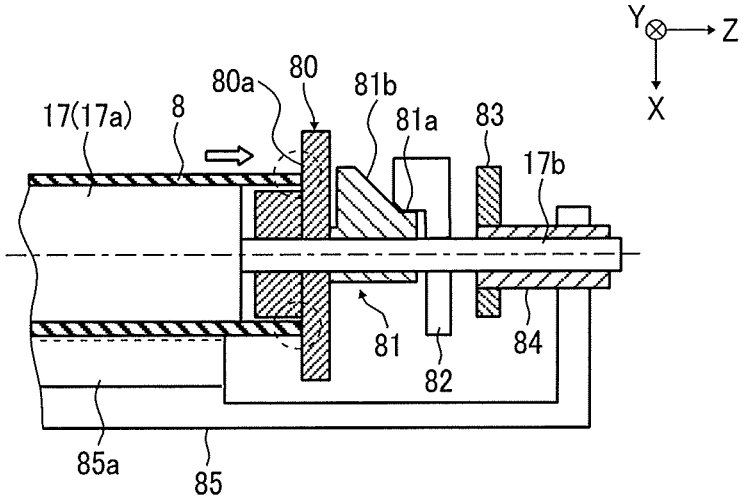
FIGS. 5A and 5B are schematic cross-sectional views illustrating movement to correct belt deviation of the intermediate transfer belt according to an embodiment of the present disclosure.
Figure 5B:
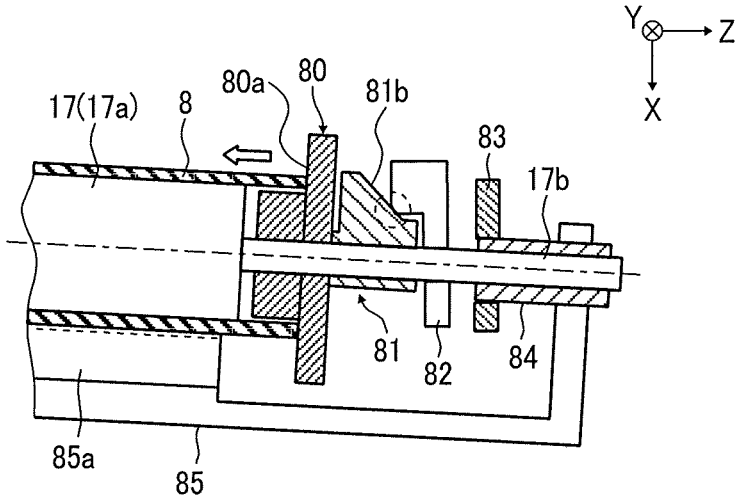

With reference to FIGS. 4, 5A, and 5B, the intermediate transfer belt device (the belt device) 15 includes the intermediate transfer belt (the belt) 8 stretched and supported around the plurality of rollers 16 through 19 and 40 and a correction mechanism 79 to correct the belt deviation of the intermediate transfer belt 8. In the correction mechanism 79, one of the plurality of rollers (i.e., the correction roller 17) is inclined relative to the axial direction of the drive roller 16.

The correction mechanism 79 causes the correction roller 17 to be inclined relative to the axial direction of the drive roller 16 in conjunction with the movement in which the intermediate transfer belt 8 moves to one side in the width direction of the intermediate transfer belt device 15 (i.e., the belt deviation occurs), thereby correcting the belt deviation of the intermediate transfer belt 8.

Specifically, as illustrated in FIG. 4, the intermediate transfer belt device 15 includes the correction roller 17, which is the one of the plurality of rollers, provided with a roller shaft 17*b* that rotates along with the correction roller 17. More specifically, the correction roller 17 includes the roller shaft 17*b* and a roller portion 17*a* that contacts the inner circumferential surface of the intermediate transfer belt 8. The roller shaft 17*b* has an outer diameter smaller than the roller portion 17*a* and projects outward from both ends of the roller portion 17*a*. For example, two roller shafts 17*b* can be separately formed to project outward from both ends of the roller portion 17*a*. Alternatively, one roller shaft 17*b* can penetrate the roller portion 17*a* to project outward from both ends of the roller portion 17*a*. In any case, in the correction roller 17 according to the present embodiment, the roller portion 17*a* and the roller shaft 17*b* are united and rotate as a single unit.

Figure 8A:
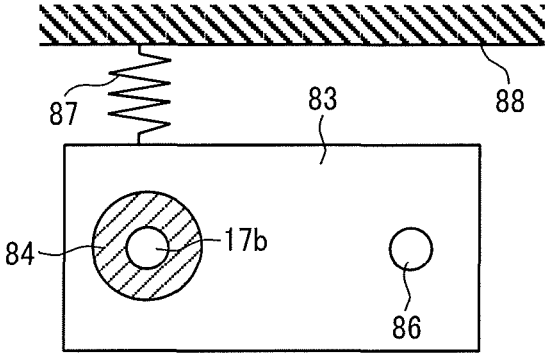
FIG. 8A is a schematic side view illustrating a support and a bearing of the intermediate transfer belt device.
Figure 8B:
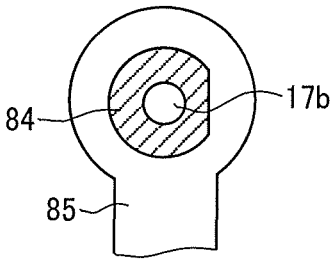
FIG. 8B is a schematic side view illustrating the bearing and a part of a cleaning member of the intermediate transfer belt device.

As illustrated in FIGS. 4, 5A, and 5B, the intermediate transfer belt device 15 further includes a bearing 84 to support the roller shaft 17*b* of the correction roller 17. With reference also to FIGS. 8A and 8B, the bearing 84 is approximately cylindrical and rotatably supported by a support 83.

The bearing 84 has an inner diameter portion with an approximately circular cross-section and rotatably support the roller shaft 17*b*. That is, the roller shaft 17*b* of the correction roller 17 is rotatably supported by the bearings 84 at both ends of the correction roller 17.

With reference to FIG. 8A, the intermediate transfer belt device 15 according to the present embodiment further includes a tension spring 87 as a biasing member. A shaft inclination member 81 (the correction mechanism 79) moves the roller shaft 17*b* of the correction roller 17 in a predetermined direction (i.e., downward in the present embodiment) to incline the correction roller 17. The tension spring 87 biases the roller shaft 17*b* in a direction opposite the predetermined direction (i.e., upward in the present embodiment) to incline the correction roller 17 (or reduce inclination of the correction roller 17).

The intermediate transfer belt device 15 further includes a frame (a housing) 88 to rotatably support the plurality of rollers 16 through 19 and 40. In the present embodiment, the support 83, which rotatably supports the bearing 84, is supported by the frame 88 and is rotatable around a spindle 86 relative to the frame 88. The bearing 84 rotatably supports the roller shaft 17*b* as illustrated in FIG. 8A and stationarily supports the cleaning member 85 that does not rotate relative to the bearing 84 as illustrated in FIG. 8B.

The support 83 and the frame 88 are coupled to each other via the tension spring (the biasing member) 87. As the shaft inclination member 81 (the correction mechanism 79) moves the roller shaft 17*b* of the correction roller 17 downward to incline the correction roller 17 in accordance with the belt deviation of the intermediate transfer belt 8, the tension spring 87 biases the roller shaft 17*b* to rotate the support 83 together with the roller shaft 17*b* upward around the spindle 86. The shaft inclination member 81 and the roller shaft 17*b* stabilize at a position where all forces balance. All forces include: force to move the intermediate transfer belt due to production tolerance, such as variance of parallelism of the plurality of rollers that stretches and supports the intermediate transfer belt 8, deviations of diameters of the plurality of rollers, or a deviation of circumference of the intermediate transfer belt 8; force to move the roller shaft 17*b* downward by the shaft inclination member 81 to incline the correction roller 17 (i.e., force generated according to movement of the intermediate transfer belt 8 in the width direction); and resilience of the tension spring 87 to move the roller shaft 17*b* upward.

In the present embodiment, the tension spring (the biasing member) 87 is provided in the intermediate transfer belt device 15. Accordingly, if the intermediate transfer belt 8 moves close to one side in the width direction of the intermediate transfer belt device 15, the correction mechanism 79 reliably returns the intermediate transfer belt 8 to the original position of the intermediate transfer belt 8.

As illustrated in FIGS. 4, 5A, and 5B, the correction mechanism 79 includes a flange (an abutment member) 80, the shaft inclination member (a guided portion) 81, and a contact member (a guide) 82.

The shaft inclination member 81 is slidably supported by the roller shaft 17*b* of the correction roller 17, which is the one of the plurality of rollers. The shaft inclination member 81 inclines the roller shaft 17*b* (the correction roller 17) in conjunction with the belt deviation, the movement of the intermediate transfer belt 8 in the width direction (the left and right direction in FIGS. 4, 5A, and 5B).

The shaft inclination member 81 includes a parallel surface 81*a* parallel to a rotation axis of the correction roller 17 and an inclined surface 81*b* inclined relative to the parallel surface 81*a*. The parallel surface 81*a* or the inclined surface 81*b* contacts the contact member 82.

The shaft inclination member 81 does not rotate in conjunction with the rotation of the intermediate transfer belt 8 or the rotation of the correction roller 17 (the roller shaft 17*b*). Specifically, the shaft inclination member 81 contacts a projection for stopping rotation disposed on the frame 88 of the intermediate transfer belt device 15. The projection inhibits the shaft inclination member 81 from rotating.

The contact member 82 contacts the parallel surface 81*a* or the inclined surface 81*b* of the shaft inclination member 81. The contact member 82 slides on the inclined surface 81*b* of the shaft inclination member 81 in conjunction with the movement of the intermediate transfer belt 8 in the width direction, thereby inclining the roller shaft 17*b* (the correction roller 17).

The flange 80 can contact an end face of the intermediate transfer belt 8. As the intermediate transfer belt 8 moves in the width direction, the flange 80 is pushed by the intermediate transfer belt 8, causing the flange 80 to move. The flange 80 rotates in conjunction with the rotation of the intermediate transfer belt 8 or the correction roller 17 (the roller shaft 17*b*). The shaft inclination member 81 contacts the flange 80 at the opposite side to the intermediate transfer belt 8.

In the present embodiment, when the belt deviation does not occur, there is a clearance between the flange 80 and the intermediate transfer belt 8 in the width direction of the intermediate transfer belt device 15. Alternatively, the flange 80 and the intermediate transfer belt 8 can be provided without the clearance. In this case, responsibility of the belt alignment (the belt deviation correction) can be improved.

A further detailed description is given of the correction mechanism 79.

The flange 80 is slidable and rotatable relative to the roller shaft 17*b* of the correction roller 17. As the intermediate transfer belt 8 moves to one side in the width direction (i.e., belt deviation occurs), the end face of the intermediate transfer belt 8 contacts an abutment portion 80*a* of the flange 80. The abutment portion 80*a* has an outer diameter sufficiently larger than the correction roller 17 (the roller portion 17*a*) so that the intermediate transfer belt 8 does not ride over the flange 80. The flange 80 rotates in conjunction with rotation of the correction roller 17.

The shaft inclination member 81 is disposed outboard of the flange 80 in the width direction. The shaft inclination member 81 is slidable and is not rotatable relative to the roller shaft 17*b* of the correction roller 17. The shaft inclination member 81 includes the parallel surface 81*a* and the inclined surface 81*b*. The shaft inclination member 81 does not rotate when the correction roller 17 rotates.

The contact member 82 is stationarily secured to the frame (the housing) 88 of the intermediate transfer belt device 15 and opposed to the shaft inclination member 81 above the roller shaft 17*b*. That is, the contact member 82 is secured so as not to rotate, irrespective of the rotation of the roller shaft 17*b* (the correction roller 17).

With such a configuration of the correction mechanism 79, the belt deviation of the intermediate transfer belt 8 (i.e., the movement of the intermediate transfer belt 8 in the left and right direction in FIGS. 4, 5A, and 5B) is corrected.

Figure 6A:
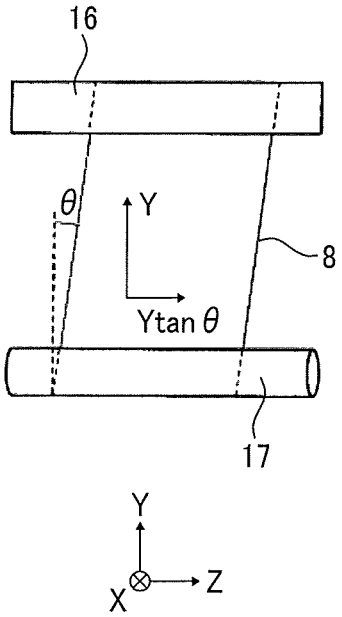
FIGS. 6A and 6B are schematic top views illustrating movement to correct belt deviation of the intermediate transfer belt according to an embodiment of the present disclosure.

Specifically, as illustrated in FIG. 6A, parallelism between the drive roller 16 and the correction roller 17 is deviated. In FIG. 6A, the correction roller 17 inclines relative to the drive roller 16 in a state in which a right-side end of the correction roller 17 has moved in negative X direction (a direction perpendicular to the surface of the paper, on which FIG. 6A is drawn, and toward the near side of the paper). At that time, the intermediate transfer belt 8 is inclined (or deflected) to the right by an inclination angle θ as viewed from the correction roller 17. As a result, as the intermediate transfer belt 8 proceeds by a distance Y, the intermediate transfer belt 8 moves to the right by Y tan θ (i.e., the belt deviation occur).

As the intermediate transfer belt 8 moves to the right, the end face of the intermediate transfer belt 8 contacts the abutment portion 80*a* of the flange 80 as illustrated in FIG. 5A, causing the flange 80 to slide to the right. Accordingly, the flange 80 pushes the shaft inclination member 81 to the right. As the shaft inclination member 81 is pushed to the right, a contact point moves from a state in which the contact member 82 contacts the parallel surface 81*a* as illustrated in FIG. 5A to a state in which the contact member 82 contacts the inclined surface 81*b* as illustrated in FIG. 5B. As a result, the correction roller 17 is inclined along the inclined surface 81*b* as illustrated in FIGS. 5B and 6B.

Figure 6B:
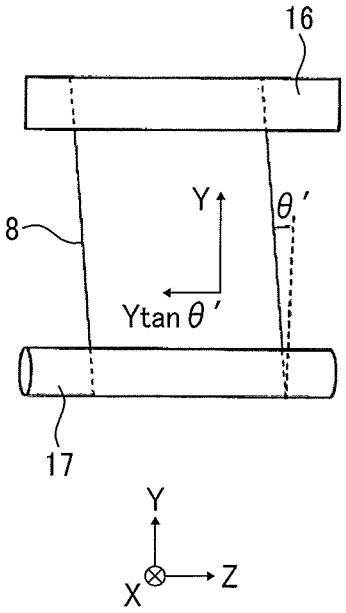

As illustrated in FIG. 6B (and FIG. 5B), the intermediate transfer belt 8 is inclined (or deflected) to the left by an inclination angle θ' as viewed from the correction roller 17 in a state in which the right-side end of the correction roller 17 moves in positive X direction (a direction perpendicular to the surface of the paper, on which FIG. 6B is drawn, and toward the far side of the paper). As a result, as the intermediate transfer belt 8 proceeds by a distance Y, the intermediate transfer belt 8 moves to the left by Y tan θ'. This movement cancels the belt deviation to the right. Thus, the correction mechanism 79 corrects the belt deviation of the intermediate transfer belt 8.

In the example in FIGS. 6A and 6B, the belt deviation is described when the parallelism between the drive roller 16 and the correction roller 17 is deviated.

However, the belt deviation of the intermediate transfer belt 8 may occur due to the deviations of outer diameters of the plurality of rollers such as the drive roller 16, the correction roller 17, or the other rollers, or a deviation of outer circumference diameter of the intermediate transfer belt 8. Even if such a belt deviation occurs, the correction roller 17 is inclined, causing the intermediate transfer belt 8 to move in opposite direction to correct the belt deviation. Thus, the correction mechanism 79 corrects the belt deviation of the intermediate transfer belt 8.

With such a configuration of the correction mechanism 79, the belt deviation of the intermediate transfer belt 8 is unlikely to occur.

In particular, in the present embodiment, the roller shaft 17*b* (the correction roller 17) can be inclined by such a simple, space-saving configuration in which the contact member 82 relatively slides on the inclined surface 81*b* of the shaft inclination member 81.

In the present embodiment, since the flange 80 is disposed between the intermediate transfer belt 8 and the shaft inclination member 81 and operated as described above, the flange 80 directly transmits force, in which the intermediate transfer belt 8 moves to one side in the width direction, to the shaft inclination member 81. Therefore, the belt deviation can be stably corrected.

In the present embodiment, the flange 80 is rotated in conjunction with the rotation of the intermediate transfer belt 8. Therefore, since the intermediate transfer belt 8 and the flange 80 are not rubbed together, an inconvenience that the end face of the intermediate transfer belt 8 abrades can be minimized. Further, since the shaft inclination member 81 does not rotate, it is not necessary to form the inclined surface 81*b* and the parallel surface 81*a* across a circumferential direction of the correction roller 17, thereby preventing the shaft inclination member 81 from increasing in size.

As described above, the roller shaft 17*b* of the correction roller 17 is rotated in conjunction with the correction roller 17 (the roller portion 17*a*). Accordingly, the shaft inclination member 81 slides on the roller shaft 17*b* when the intermediate transfer belt 8 moves to one side in the width direction during rotation and the shaft inclination member 81 is displaced. At that time, a coefficient of kinetic friction between the roller shaft 17*b* and the shaft inclination member 81 is smaller than a coefficient of static friction between the roller shaft 17*b* and the shaft inclination member 81. Therefore, with such a configuration in which the roller shaft 17*b* is rotated in conjunction with the correction roller 17 (the roller portion 17*a*), frictional force between the roller shaft 17*b* and the shaft inclination member 81 is lowered as compared with a configuration in which the roller shaft 17*b* is not rotated in conjunction with the correction roller 17 (the roller portion 17*a*). Accordingly, the shaft inclination member 81 can be reliably displaced even if force in which the intermediate transfer belt 8 moves the shaft inclination member 81 is small. Accordingly, a load on the end face of the intermediate transfer belt 8 can be reduced, thereby extending the life of the intermediate transfer belt 8. With such a configuration, the belt deviation can be reliably corrected.

The intermediate transfer belt device 15 according to the present embodiment includes the cleaning member 85 opposed to the correction roller 17 (i.e., the one of the plurality of rollers) via the intermediate transfer belt (the belt) 8 to clean the intermediate transfer belt 8. The cleaning member 85 includes a holder made of sheet metal and the cleaning portion 85*a* bonded to the holder. In the present embodiment, the cleaning portion 85*a* is the cleaning blade that is plate-shaped and made of urethane rubber. Alternatively, the cleaning portion 85*a* can be made of felt or nonwoven fabric. As indicated by the dashed line in FIG. 4, the cleaning portion 85*a* contacts the outer circumferential surface of the intermediate transfer belt 8 in the width direction to remove the substances such as toner and paper dust adhering to the surface of the intermediate transfer belt 8. The substances removed by the cleaning portion 85*a* (the cleaning member 85) are collected inside the belt cleaner 10.

As illustrated in FIGS. 4 and 8B, in the present embodiment, the cleaning member 85 is stationarily supported by the bearing 84. Accordingly, the cleaning member 85 does not rotate in conjunction with the roller shaft 17*b* (and the roller portion 17*a*).

Specifically, an outer circumference of the bearing 84 is D-shaped (i.e., processed by D cut), and an arm of the cleaning member 85 has a D-shaped hole into which the bearing 84 with D-shape fits. As a result, the cleaning member 85 is supported by the bearing 84 and is not rotatable relative to the bearing 84. On the other hand, as described above, the bearing 84 is rotatably supported by the support 83, and the roller shaft 17*b* is rotatably supported be the bearing 84. Therefore, the cleaning member 85 and the bearing 84 rotate together but independently rotate relative to the roller shaft 17*b* (the correction roller 17).

Figure 7A:
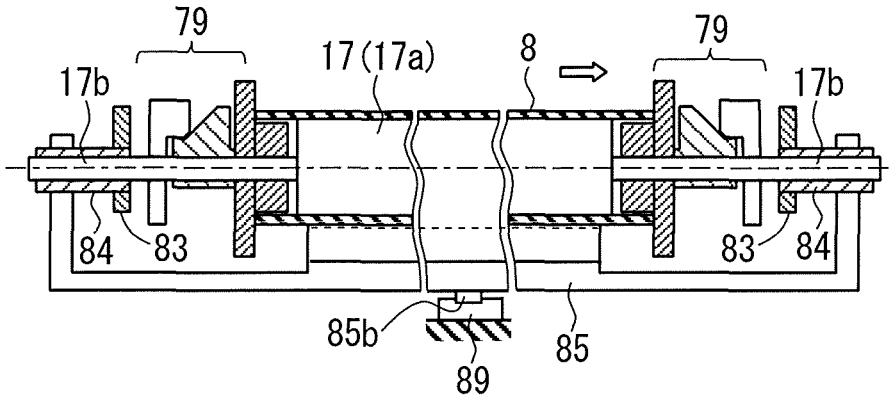
FIG. 7A is a schematic view illustrating an initial posture of the correction roller.
Figure 7B:
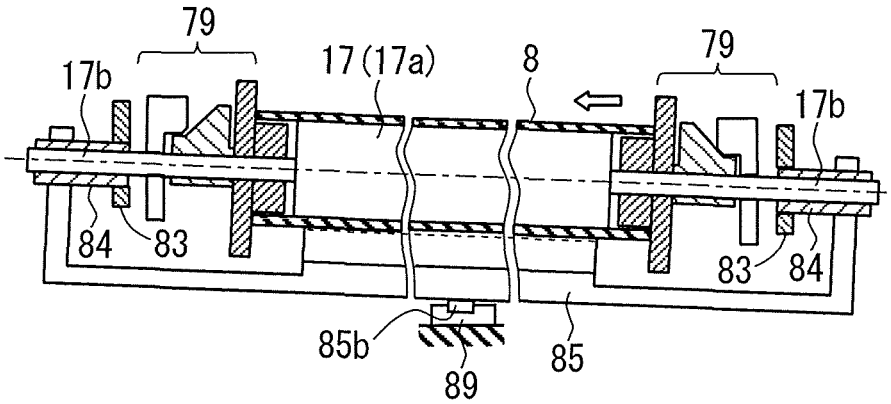
FIG. 7B is a schematic view illustrating a posture of the correction roller in a stable state.

Thus, in the present embodiment, the cleaning member 85 is supported by the roller shaft 17*b* via the bearing 84, and the bearing 84 is coaxial to the roller shaft 17*b*. Accordingly, the intermediate transfer belt 8 and the cleaning member 85 are accurately positioned relative to the roller shaft 17*b*, and the position relation between the intermediate transfer belt 8 and the cleaning member 85 (the cleaning portion 85*a*) can be maintained with high accuracy. That is, as illustrated in FIGS. 7A and 7B, the cleaning member 85 is inclined in conjunction with movement of inclination of the roller shaft 17*b* (the correction roller 17) to correct the belt deviation of the intermediate transfer belt 8, while keeping the position relation relative to the intermediate transfer belt 8 (and the correction roller 17) via the bearings 84. As a result, an inconvenience that the cleaning member 85 does not clean the intermediate transfer belt 8 well, and contamination of the intermediate transfer belt 8 (i.e., cleaning failure) causes abnormal images is minimized. In the intermediate transfer belt device 15 according to the present embodiment, correction of the belt deviation is satisfactorily performed, and the position relation between the intermediate transfer belt 8 and the cleaning member 85 can be reliably maintained.

In the present embodiment, since the cleaning member 85 is rotatable relative to the roller shaft 17*b* (and the roller portion 17*a*), the contact state of the cleaning member 85 relative to the intermediate transfer belt 8 can be maintained with high accuracy.

That is, when the roller shaft 17*b* (the correction roller 17) is inclined to correct the belt deviation of the intermediate transfer belt 8, if the cleaning member 85 is about to twist, the cleaning member 85 is rotated relative to the roller shaft 17*b* by rigidity of the cleaning member 85 in a direction in which the twist of the cleaning member 85 is eliminated. As a result, an inconvenience that the cleaning member 85 twists in the width direction is minimized. Therefore, an inconvenience that the cleaning ability of the cleaning member 85 relative to the intermediate transfer belt 8 decreases due to the twist of the cleaning member 85 is minimized.

As illustrated in FIGS. 7A and 7B, in the present embodiment, the shaft inclination member 81 (the correction mechanism 79) is disposed on each of the roller shafts 17*b* at both ends of the correction roller 17 (the one of the plurality of rollers) in the width direction.

As illustrated in FIG. 7A, if the intermediate transfer belt 8 moves to one side in the width direction (i.e., the belt deviation occurs) after the correction roller 17 is initially set in parallel to the drive roller 16, one of the correction mechanisms 79 at both ends operates to correct the belt deviation, and the correction roller 17 finally takes a stable posture. FIG. 7B illustrates a state in which, when the intermediate transfer belt 8 moves to the right in FIG. 7A, the correction mechanism 79 on the right side in FIG. 7B operates, and the correction roller 17 takes the stable posture. Specifically, the shaft inclination member 81 and the roller shaft 17*b* stabilize at a position where all forces balance. All forces include: force to move the intermediate transfer belt due to production tolerance, such as variance of parallelism of the plurality of rollers that stretches and supports the intermediate transfer belt 8, deviations of diameters of the plurality of rollers, or a deviation of circumference of the intermediate transfer belt 8; and force to move the roller shaft 17*b* downward by the shaft inclination member 81 to incline the correction roller 17 (i.e., force generated according to movement of the intermediate transfer belt 8 in a width direction).

Thus, since the shaft inclination member 81 (the correction mechanism 79) is disposed at each of both ends of the correction roller 17, the inclination of the correction roller 17 is small as compared with the intermediate transfer belt device 15 with the shaft inclination member 81 (the correction mechanism 79) disposed at one end of the correction roller 17.

As illustrated in FIGS. 7A and 7B, the intermediate transfer belt device (the belt device) 15 further includes a stopper 89 disposed on the frame 88 of the intermediate transfer belt device 15 at the center in the width direction to inhibit the cleaning member 85 from rotating.

The cleaning member 85 includes a contact portion (a projection) 85*b* that can contact the stopper 89 at the center of the cleaning member 85 in the width direction.

With such a configuration, even if the cleaning member 85 receives force to rotate the cleaning member 85 around the rotation axis of the correction roller 17 due to sliding resistance with the intermediate transfer belt 8, the contact of the contact portion 85*b* with the stopper 89 prevents the cleaning member 85 from rotating. As a result, the position of the cleaning member 85 in a rotation direction is determined, and an inconvenience that the cleaning member 85 twists is minimized.

Figure 9A:
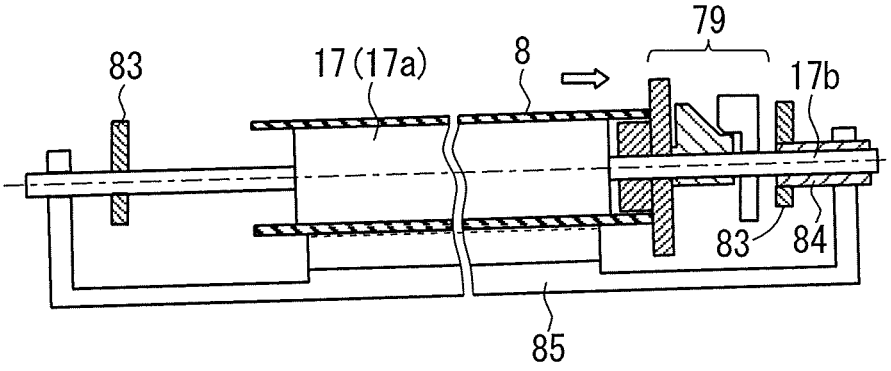
FIG. 9A is a schematic view illustrating an initial posture of the correction roller according to a first variation.
Figure 9B:
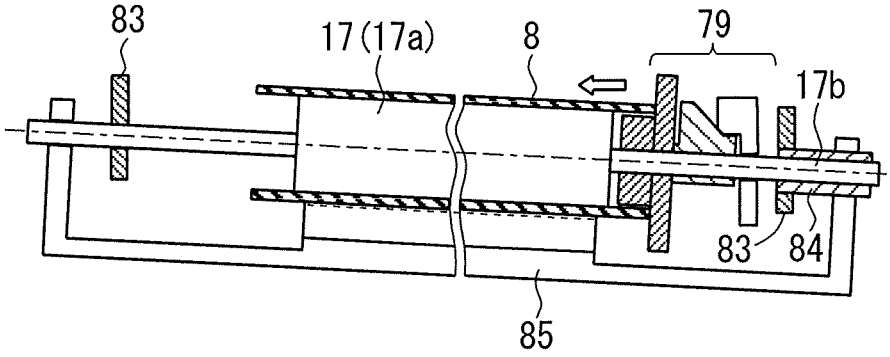
FIG. 9B is a schematic view illustrating a posture of the correction roller in a stable state according to the first variation.

FIG. 9A illustrates a correction roller 17 in an initial posture according to a first variation, and FIG. 9B illustrates the correction roller 17 in a stable posture. FIGS. 9A and 9B correspond to FIGS. 7A and 7B according to the above-described embodiment, respectively.

As illustrated in FIGS. 9A and 9B, the intermediate transfer belt device 15 according to the first variation is different from the above-described embodiment. In the first variation, the shaft inclination member 81 (the correction mechanism 79) is disposed on the roller shaft 17*b* at one end of the correction roller 17 (the one of the plurality of rollers) in the width direction.

As illustrated in FIG. 9A, in the initial state, the correction roller 17 is inclined from a state in which the correction roller 17 is in parallel to the drive roller 16 so that the intermediate transfer belt 8 does not move toward the other end of the correction roller 17 in the width direction (i.e., left direction in FIG. 9A). If the intermediate transfer belt 8 moves to the right in FIG. 9A, the correction mechanism 79 operates to correct the belt deviation, and the correction roller 17 finally takes stable posture as illustrated in FIG. 9B.

With such a configuration, the cleaning member 85 is supported by the roller shaft 17*b* via the bearing 84, and the bearing 84 is coaxial with the roller shaft 17*b*. Accordingly, correction of the belt deviation is satisfactorily performed, and the position relation between the intermediate transfer belt 8 and the cleaning member 85 can be reliably maintained.

Further, since the cleaning member 85 is rotatable relative to the roller shaft 17*b*, the cleaning member 85 does not twist, the contact state of the cleaning member 85 relative to the intermediate transfer belt 8 can be maintained with high accuracy.

In the first variation, the shaft inclination member 81 (the correction mechanism 79) is disposed on the roller shaft 17*b* at one end of the correction roller 17. This configuration can reduce the number of components and the cost of the intermediate transfer belt device 15 as compared with the intermediate transfer belt device 15 in which the shaft inclination member 81 (the correction mechanism 79) is disposed on the roller shaft 17*b* at each of both ends of the correction roller 17.

Figure 10A:
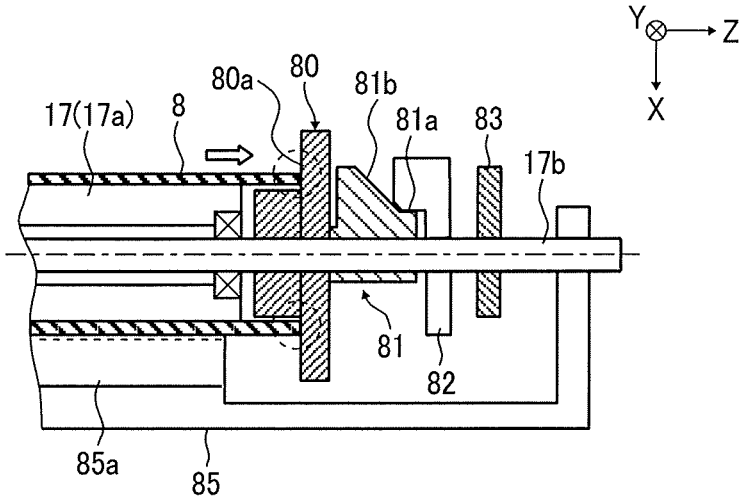
FIGS. 10A and 10B are schematic cross-sectional views of a main part of the intermediate transfer belt device, illustrating movement to correct belt deviation of the intermediate transfer belt according to a second variation.
Figure 10B:
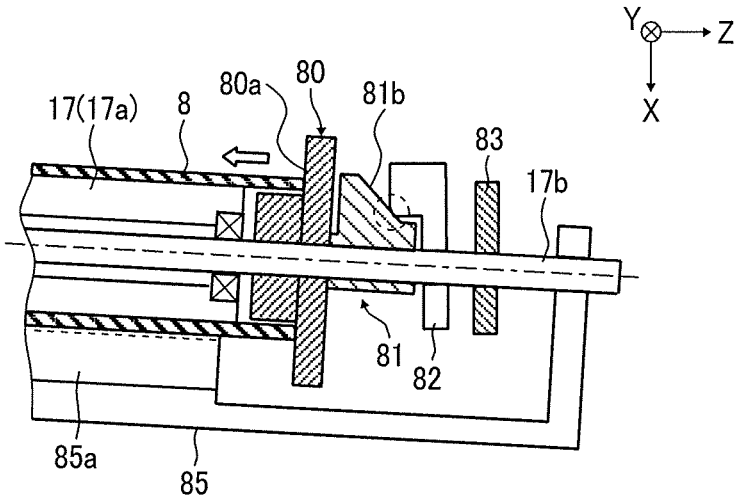
Figure 11A:
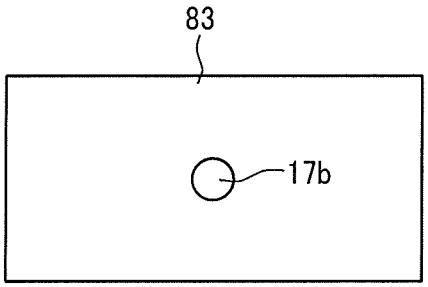
FIG. 11A is a schematic side view illustrating a support and a roller shaft of the intermediate transfer belt device in FIGS. 10A and 10B.
Figure 11B:
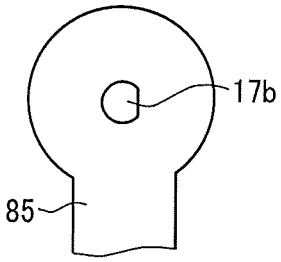
FIG. 11B is a schematic side view illustrating the roller shaft and a part of a cleaning member of the intermediate transfer belt device in FIGS. 10A and 10B.

FIGS. 10A and 10B are schematic cross-sectional views illustrating operations of correction of the belt deviation of the intermediate transfer belt 8 according to a second variation, corresponding to FIGS. 5A and 5B according to the above-described embodiment. FIG. 11A is a schematic side view of the support 83 and the roller shaft 17*b*, and FIG. 11B is a schematic side view illustrating the roller shaft 17*b* and a part of the cleaning member 85.

As illustrated in FIGS. 10A and 10B, the intermediate transfer belt device 15 according to the second variation includes the flange 80, the shaft inclination member 81, the correction mechanism 79 including the contact member 82, and the cleaning member 85, similarly to the above-described embodiment.

The roller shaft 17*b* of the correction roller 17 (the one of the plurality of rollers) according to the second variation is different from that of the above-described embodiment. In the second variation, the roller shaft 17*b* independently rotates relative to the roller portion 17*a*. Specifically, the roller portion 17*a* is a hollow structure, and bearings are pressed into both ends of the hollow structure in the width direction. The roller shaft 17*b* penetrates a hollow part of the roller portion 17*a* and supports the roller portion 17*a* via the bearings. Therefore, the roller shaft 17*b* does not rotate along with rotation of the roller portion 17*a*, and the roller portion 17*a* does not rotate along with rotation of the roller shaft 17*b*. Meanwhile, the roller shaft 17*b* and roller portion 17*a* are inclined together by operation of the correction mechanism 79.

As illustrated in FIGS. 10A, 10B, and 11A, in the second variation, the support 83 rotatably supports the roller shaft 17*b*. Specifically, a columnar portion of the roller shaft 17*b* is inserted into a cylindrical hole of the support 83.

As illustrated in FIGS. 10A, 10B, and 11B, the cleaning member 85 is stationarily supported by the roller shaft 17*b*. Therefore, the cleaning member 85 rotates along with the roller shaft 17*b*, but does not rotate along with the roller portion 17*a*. Specifically, an outer circumference of the roller shaft 17*b* is D-shaped (i.e., processed by D cut), and the arm of the cleaning member 85 has the D-shaped hole into which the roller shaft 17*b* with D-shape fits. Therefore, the cleaning member 85 is supported by the roller shaft 17*b* and is not rotatable relative to the roller shaft 17*b*. As described above, the roller shaft 17*b* is rotatably supported by the support 83, and the roller shaft 17*b* does not rotate along with the roller portion 17*a*. As a result, if the roller portion 17*a* rotates along with the intermediate transfer belt 8, the cleaning member 85 and the roller shaft 17*b* do not rotate along with the rotation of the intermediate transfer belt 8.

Thus, in the second variation, the cleaning member 85 is directly supported by the roller shaft 17*b*. Accordingly, the intermediate transfer belt 8 and the cleaning member 85 are more accurately positioned relative to the roller shaft 17*b*. Therefore, the position relation between the intermediate transfer belt 8 and the cleaning member 85 (the cleaning portion 85*a*) can be maintained with further accuracy.

In the second variation, since the cleaning member 85 is rotatable relative to the roller portion 17*a*, the contact state of the cleaning member 85 relative to the intermediate transfer belt 8 can be maintained with high accuracy. That is, when the roller shaft 17*b* (the correction roller 17) is inclined to correct the belt deviation of the intermediate transfer belt 8, if the cleaning member 85 is about to twist, the cleaning member 85 is rotated relative to the roller portion 17*a* by rigidity of the cleaning member 85 in the direction in which the twist of the cleaning member 85 is eliminated, thereby preventing the cleaning member 85 from twisting. Therefore, an inconvenience that the cleaning ability of the cleaning member 85 relative to the intermediate transfer belt 8 decreases due to the twist of the cleaning member 85, and cleaning failure occurs is minimized.

Note that, the configuration of the stopper 89 as described above with reference to FIGS. 7A and 7B and the configuration in the first variation are adoptable to the second variation.

As described above, the intermediate transfer belt device 15 according to the above-described embodiments includes the roller shaft 17*b* that rotates along with the correction roller 17 (the one of the plurality of rollers), the shaft inclination member 81 configured to incline the roller shaft 17*b* in conjunction with movement in which the intermediate transfer belt 8 moves to one side in the width direction of the intermediate transfer belt device 15, the cleaning member 85 configured to clean the intermediate transfer belt 8, the bearing 84 configured to rotatably support the roller shaft 17*b*, and the support 83 configured to rotatably support the bearing 84. The cleaning member 85 is stationarily supported by the bearing 84.

As a result, when the correction roller 17 is inclined, the cleaning member 85 is unlikely to twist.

Therefore, according to the present disclosure, a belt device and an image forming apparatus can be provided in which a cleaning member is unlikely to twist when a roller is inclined.

It is to be noted that the above-described embodiments according to the present disclosure is applied to, but not limited to, the intermediate transfer belt device 15 in which the belt deviation of the intermediate transfer belt 8 as a belt is corrected. For example, the present disclosure can be applied to a belt device in which the belt deviation of a belt, such as the secondary transfer belt 72, a photoconductor belt, a transfer conveyance belt, a fixing belt, and the like, is corrected.

Further, in the above-described embodiments, the present disclosure is applied to the image forming apparatus 100 that forms the color image. On the other hand, the present disclosure can also be applied to an image forming apparatus that forms only a monochrome image.

In such configurations, effects similar to those described above are also attained.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. A belt device comprising:

a plurality of rollers;

a belt stretched and supported around the plurality of rollers;

a roller shaft included in one of the plurality of rollers and configured to rotate along with the one of the plurality of rollers;

a shaft inclination member slidably supported by the roller shaft and configured to incline the roller shaft in conjunction with movement in which the belt moves in a width direction of the belt device;

a cleaning member opposed to the one of the plurality of rollers via the belt and configured to clean the belt;

a bearing configured to rotatably support the roller shaft and stationarily support the cleaning member; and a support configured to rotatably support the bearing.

2. The belt device according to claim 1, wherein the shaft inclination member is disposed on the roller shaft at each end of the one of the plurality of rollers.

3. The belt device according to claim 1, wherein the shaft inclination member is disposed on the roller shaft at one end of the one of the plurality of rollers.

4. The belt device according to claim 1, further comprising a biasing member configured to bias the roller shaft inclined in a predetermined direction by the shaft inclination member, so as to move the roller shaft in a direction opposite to the predetermined direction to incline the one of the plurality of rollers.

5. The belt device according to claim 1, further comprising a stopper disposed at a center of the cleaning member in the width direction of the belt device and configured to restrict rotation of the cleaning member.

6. The belt device according to claim 1, further comprising:

a flange configured to contact an end face of the belt with one side of the flange, rotate along with rotation of the belt, and be pushed by the belt to move in conjunction with the movement in which the belt moves in the width direction of the belt device; and a contact member configured to contact an inclined surface of the shaft inclination member and slide on the inclined surface in conjunction with the movement in which the belt moves in the width direction of the belt device, to incline the roller shaft, wherein the shaft inclination member is configured to contact another side of the flange opposite to the one side of the flange and not to rotate along with the rotation of the belt.

7. An image forming apparatus comprising the belt device according to claim 1.

8. A belt device comprising:

a plurality of rollers;

a belt stretched and supported around the plurality of rollers;

a roller shaft included in one of the plurality of rollers and configured to rotate independently of the one of the plurality of rollers;

a shaft inclination member slidably supported by the roller shaft and configured to incline the roller shaft in conjunction with movement in which the belt moves in a width direction of the belt device;

a cleaning member opposed to the one of the plurality of rollers via the belt and configured to clean the belt; and a support configured to rotatably support the roller shaft, with the roller shaft being configured to stationarily support the cleaning member.

9. The belt device according to claim 1, further comprising a contact member configured to contact an inclined surface of the shaft inclination member, wherein the shaft inclination member includes a parallel surface parallel to a rotation axis of the roller shaft and an inclined surface inclined relative to the parallel surface, and the contact member is configured to slide on one of the parallel surface and the inclined surface.

10. The belt device according to claim 8, further comprising a contact member configured to contact an inclined surface of the shaft inclination member, wherein the shaft inclination member includes a parallel surface parallel to a rotation axis of the roller shaft and an inclined surface inclined relative to the parallel surface, and the contact member is configured to slide on one of the parallel surface and the inclined surface.

* * * * *